US007980519B2

(12) United States Patent
Chen

(10) Patent No.: US 7,980,519 B2
(45) Date of Patent: Jul. 19, 2011

(54) TELESCOPIC ADJUSTABLE POSITIONING DEVICE

(76) Inventor: Chao-Ken Chen, Chung-Hua Hsien (TW)

( * ) Notice: Subject to any disclaimer, the term of this patent is extended or adjusted under 35 U.S.C. 154(b) by 766 days.

(21) Appl. No.: 12/013,480

(22) Filed: Jan. 14, 2008

(65) Prior Publication Data

US 2008/0156962 A1 Jul. 3, 2008

(51) Int. Cl.
*A47F 5/00* (2006.01)
*F16M 11/00* (2006.01)

(52) U.S. Cl. ..... 248/125.8; 248/161; 248/408; 403/109.1; 297/338; 135/140

(58) Field of Classification Search ..... 248/161, 248/404, 407, 408, 410, 411, 413, 412, 423, 248/128.5, 125.3, 287.1, 409, 354.5, 188.5; 403/109.1, 109.2, 109.3, 109.5, 109.6, 109.7, 403/109.8, 377, 378, 379.5, 379.4, 108, 322.3, 403/324, 328, 325; 297/338, 339, 344.12, 297/344.18; 135/140, 142, 141
See application file for complete search history.

(56) References Cited

U.S. PATENT DOCUMENTS

| | | | | |
|---|---|---|---|---|
| 701,238 | A * | 5/1902 | Weber | 292/61 |
| 1,263,502 | A * | 4/1918 | Wolff | 248/408 |
| 1,610,069 | A * | 12/1926 | Weber | 248/623 |
| 2,571,512 | A * | 10/1951 | Youngberg | 403/108 |
| 2,708,493 | A * | 5/1955 | Badertscher et al. | 52/115 |
| 2,909,212 | A * | 10/1959 | Scherer | 248/408 |
| 3,443,784 | A * | 5/1969 | Walkinshaw | 248/408 |
| 3,770,236 | A * | 11/1973 | Marsh et al. | 248/408 |
| 4,021,126 | A * | 5/1977 | Deeter et al. | 403/9 |
| 4,113,221 | A * | 9/1978 | Wehner | 248/408 |
| 4,165,854 | A * | 8/1979 | Duly | 248/408 |
| 4,867,406 | A * | 9/1989 | Lengacher | 248/409 |
| 5,243,921 | A * | 9/1993 | Kruse et al. | 108/147 |
| 5,366,191 | A * | 11/1994 | Bekanich | 248/125.1 |
| 6,575,656 | B2 * | 6/2003 | Suh | 403/109.6 |
| 7,364,533 | B2 * | 4/2008 | Baker | 482/57 |
| RE40,657 | E * | 3/2009 | Suh | 403/109.3 |
| 2002/0179134 | A1 * | 12/2002 | Suh | 135/141 |
| 2006/0078376 | A1 * | 4/2006 | Liao | 403/378 |
| 2007/0003361 | A1 * | 1/2007 | Wang | 403/109.3 |

FOREIGN PATENT DOCUMENTS

DE 4242119 A1 * 6/1994

* cited by examiner

*Primary Examiner* — Kimberly T Wood

(57) ABSTRACT

A telescopic adjustable positioning device comprises an outer sleeve; a telescopic tube receiving into the outer sleeve at one end thereof and having a plurality of positioning holes; a retaining seat being a hollow tube and enclosing a connection of the outer sleeve and the telescopic tube; one side of the retaining seat being formed with a receiving portion; a slot being formed in the receiving portion; and a bottom side of the slot having a through hole which is smaller than the slot; a pin capable of passing through the retaining seat and the outer sleeve to be retained to the positioning hole of the telescopic tube; and an operation unit assembled to the receiving portion of the retaining seat. The pin is received in the slot and the through hole; and two springs are attached to the pin.

12 Claims, 8 Drawing Sheets

TELESCOPIC ADJUSTABLE POSITIONING DEVICE

FIELD OF THE INVENTION

The present invention relates to positioning devices, and particularly to a telescopic adjustable positioning device, in that a pin can be inserted to a desired positioning hole in the telescopic tube so that the adjustment work is performed easily and conveniently.

BACKGROUND OF THE INVENTION

Currently, many furniture are designed to be adjustable in elevations, such as desks, chairs, etc. so as to have a preferred arrangement to make user feel comfortable in use.

However after adjusting, the parts of the furniture must be fixed. In one prior art computer desk, a table plate is fixed by an air pressure bar and a supporting rod. A telescopic tube is embedded into the support rod. The telescopic tube resists against a frame plate. One side of the telescopic tube has a plurality of positioning holes for screwing. The movement of the air pressure bar can adjust the elevation of the table plate. Then a retainer is used to fix the table plate to a supporting rod continuously so that the elevation of the table plate is adjusted. When a proper height is achieved, screws pass through the positioning holes of the telescopic tube so as to position the frame plate.

However in above prior art, the adjustment of the table plate is continuous, while the positioning is difficult, and particularly to when the computer desk has supported with a computer and other devices. The supporting of the air pressure bar and supporting rod can not prevent the screw from loosing (especially when it is used for a long time and thus the material is fatigue).

SUMMARY OF THE INVENTION

Accordingly, the primary object of the present invention is to provide a telescopic adjustable positioning device, in that a pin can be inserted to a desired positioning hole in the telescopic tube so that the adjustment work is performed easily and conveniently.

To achieve above objects, the present invention provides a telescopic adjustable positioning device comprises an outer sleeve; a telescopic tube receiving into the outer sleeve at one end thereof and having a plurality of positioning holes; a retaining seat being a hollow tube and enclosing a connection of the outer sleeve and the telescopic tube; one side of the retaining seat being formed with a receiving portion; a slot being formed in the receiving portion; and a bottom side of the slot having a through hole which is smaller than the slot; a pin capable of passing through the retaining seat and the outer sleeve to be retained to the positioning hole of the telescopic tube; and an operation unit assembled to the receiving portion of the retaining seat; and wherein the pin is received in the slot and the through hole; an outer surface of the pin has a flange; a first spring enclosing the pin and between the flange and a bottom side of the slot; a diameter of the first spring being greater than that of the through hole; the operation unit has a track for driving the pin to move toward the through hole and the positioning hole of the telescopic tube.

The various objects and advantages of the present invention will be more readily understood from the following detailed description when read in conjunction with the appended drawing.

DETAILED DESCRIPTION OF THE INVENTION

In order that those skilled in the art can further understand the present invention, a description will be provided in the following in details. However, these descriptions and the appended drawings are only used to cause those skilled in the art to understand the objects, features, and characteristics of the present invention, but not to be used to confine the scope and spirit of the present invention defined in the appended claims.

Figure 1:
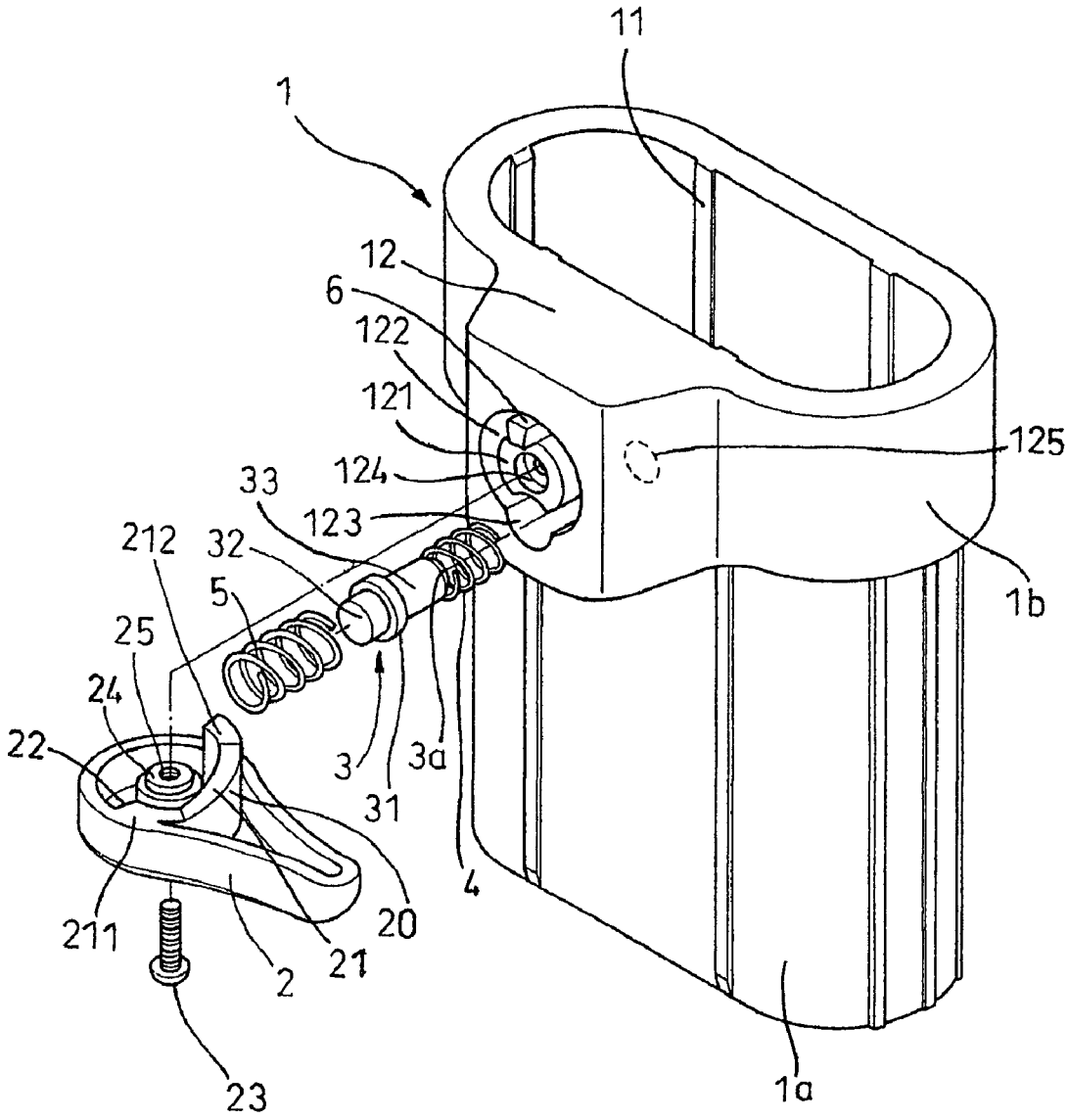
FIG. 1 is an exploded perspective view of the telescopic adjustable positioning device of the present invention.
Figure 2:
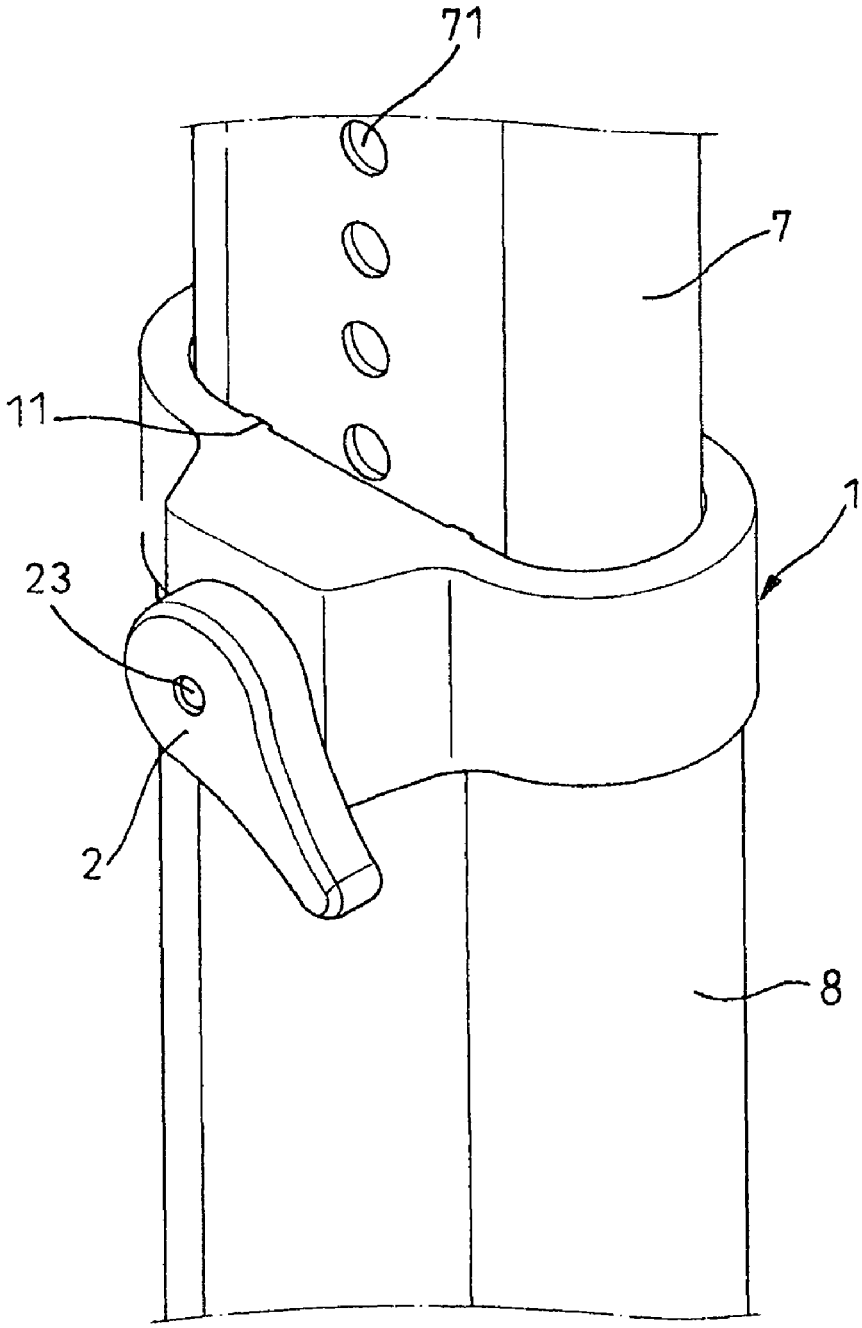
FIG. 2 is an assembled schematic view of the telescopic adjustable positioning device of the present invention.

Referring to FIGS. 1 and 2, the telescopic positioning device of the present invention is illustrated. The present invention includes an outer sleeve 8, a telescopic tube 7 receiving into the outer sleeve 8 and having a plurality of positioning holes 71; a retaining seat 1 enclosing a connection of the outer sleeve 8 and the telescopic tube 7, a pin 3 capable of passing through the retaining seat 1 and the outer sleeve 8 to be retained to the positioning hole 71 of the telescopic tube 7, a first spring 4 installed at one end of the pin 3 and a second spring 5 installed at another end of the pin 3; and an operation unit 2 assembled to the retaining seat 1 for driving the pin 3 to move toward the positioning holes 71.

The retaining seat 1 is a hollow tube, as shown in FIG. 1. The retaining seat 1 has a body 1*a* and a toggle 1*b*. The body 1*a* is received in the outer sleeve 8 and the toggle 1*b* exposes out, or the retaining seat 1 is installed to one end of the outer sleeve 8 so as to be integrally formed with the outer sleeve 8. An inner surface of the retaining seat 1 is formed with a plurality of ribs 11 for reducing the friction as the toggle 1*b* sliding along the surface of the telescopic tube 7. One side of the retaining seat 1 is formed with a projecting portion 12. An outer surface of the projecting portion 12 is formed with a guide groove 122. An annular protrusion 121 protrudes out from an inner side of the guide groove 122. An inner side of the annular protrusion 121 is formed with a passing hole 124 for retaining the operation unit 2. A lower side of the guide groove 122 is communicated to a slot 123. An inner bottom of the slot 123 has a through hole 125 which has a size smaller than that of the slot 123. The through hole 125 can communicate with one of the positioning holes 71 of the telescopic tube 7 for receiving the pin 3 and the first spring 4 and second spring 5 so as to communicate with the guide groove 122. An upper side of the guide groove 122 has a blocker 6 at a side opposite to the side having the slot 123.

The operation unit 2 has a stud 24 at an inner surface thereof. The stud 24 has a threaded hole 25. A screw 23 passes through the threaded hole 25 of the stud 24 so as to assemble the operation unit 2 to the passing hole 124 in the projecting portion 12 of the retaining seat 1. A protruded track 20 is formed aside the stud 24. An upper surface of the track 20 is an inclined surface 21. Two ends of the track 20 are connected to a first surface 211 and a second surface 212. The first surface 211 and second surface 212 are planes. One end of the first surface 211 is formed with end portion 22.

Figure 7:
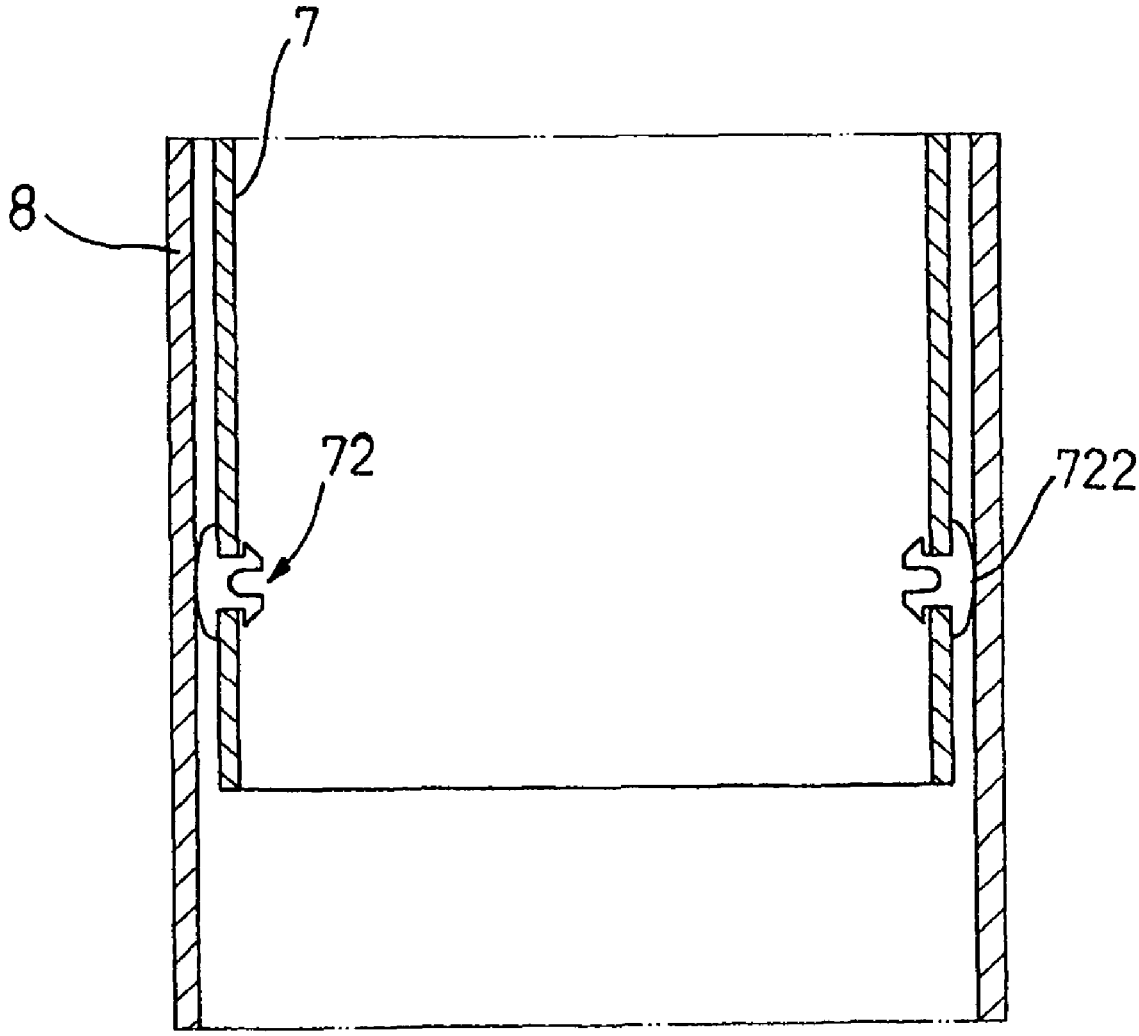
FIG. 7 is a partial schematic cross sectional view about the telescopic adjustable positioning device of the present invention after assembly.
Figure 8:
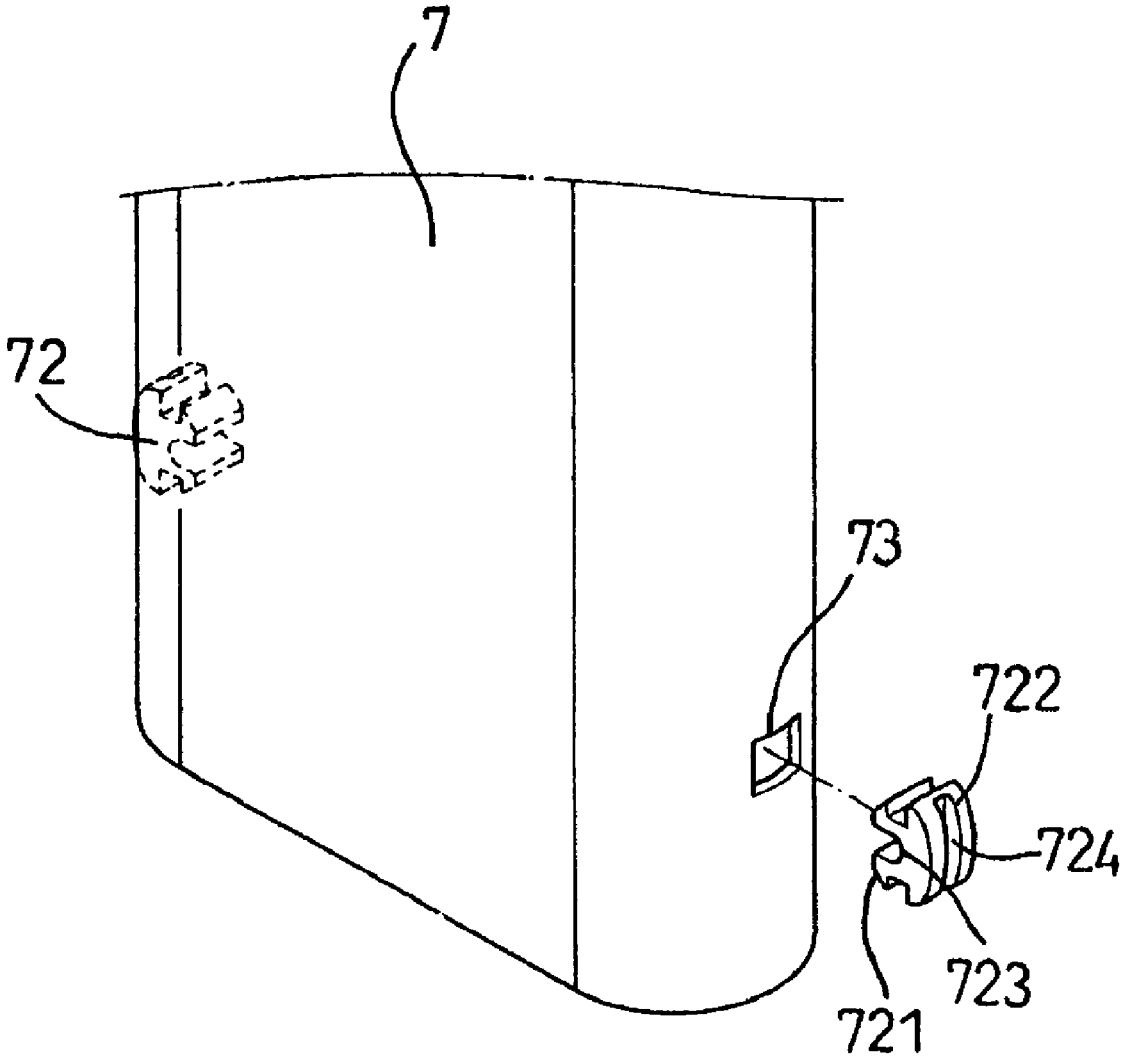
FIG. 8 is a schematic view of the embodiment related to the FIG. 7.

The pin 3 has a flange 31. The flange 31 divides the pine 3 into a first post 33 and a second post 32. The first post 33 has a tapered end 3*a*. The first spring 4 is engaged to the first post 33 and the second spring 5 is engaged to the second post 32. A diameter of the pin 3 is smaller than that of the through hole 125 of the retaining seat 1 and the positioning hole 71 of the telescopic tube 7. A diameter of the first spring 4 is larger than that of the through hole 125. One end of the telescopic tube 7 is received in the outer sleeve 8. Another end of the telescopic tube 7 serves to support an object, such as the table plate 9 illustrated in FIGS. 5 and 6. Referring to FIGS. 7 and 8, the telescopic tube 7 is formed with a fixing hole 73. An elastic unit 72 is installed in the fixing hole 73 so that as the telescopic tube 7 is installed within the outer sleeve 8, the elastic unit 72 will resist against the inner wall of the outer sleeve 8 so that the telescopic tube 7 will not vibrate. The elastic unit 72 has two hooked legs 721. A recess portion 723 is formed between the two legs 721 for deformation in installing the elastic unit 72 into the fixing hole 73. A surface of the elastic unit 72 contacting the outer sleeve 8 is formed as a resisting surface 722. A recess 724 is formed in the resisting surface 722.

Figure 3:
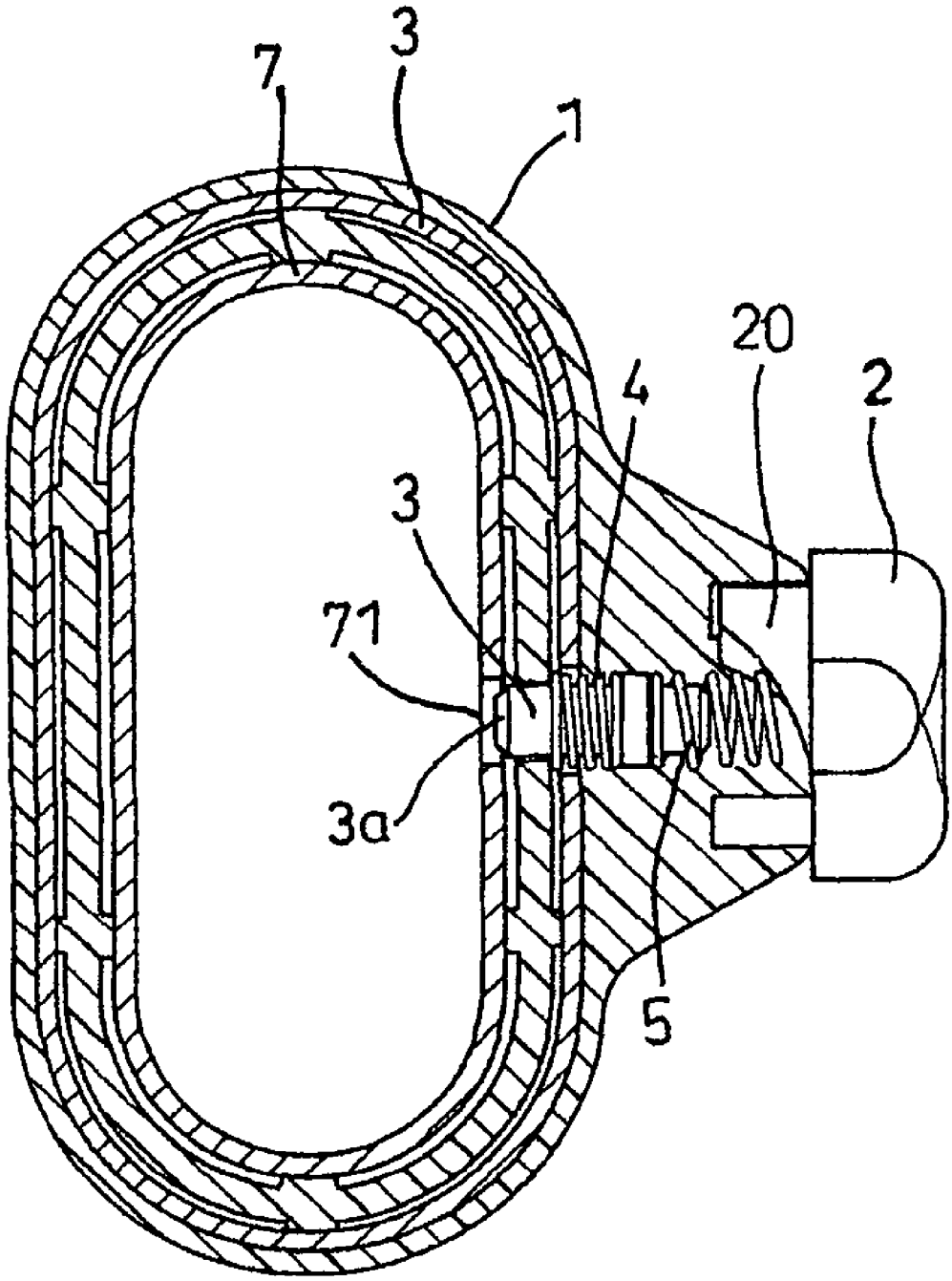
FIG. 3 is a partial cross sectional view of the telescopic adjustable positioning device of the present invention before actuation.
Figure 4:
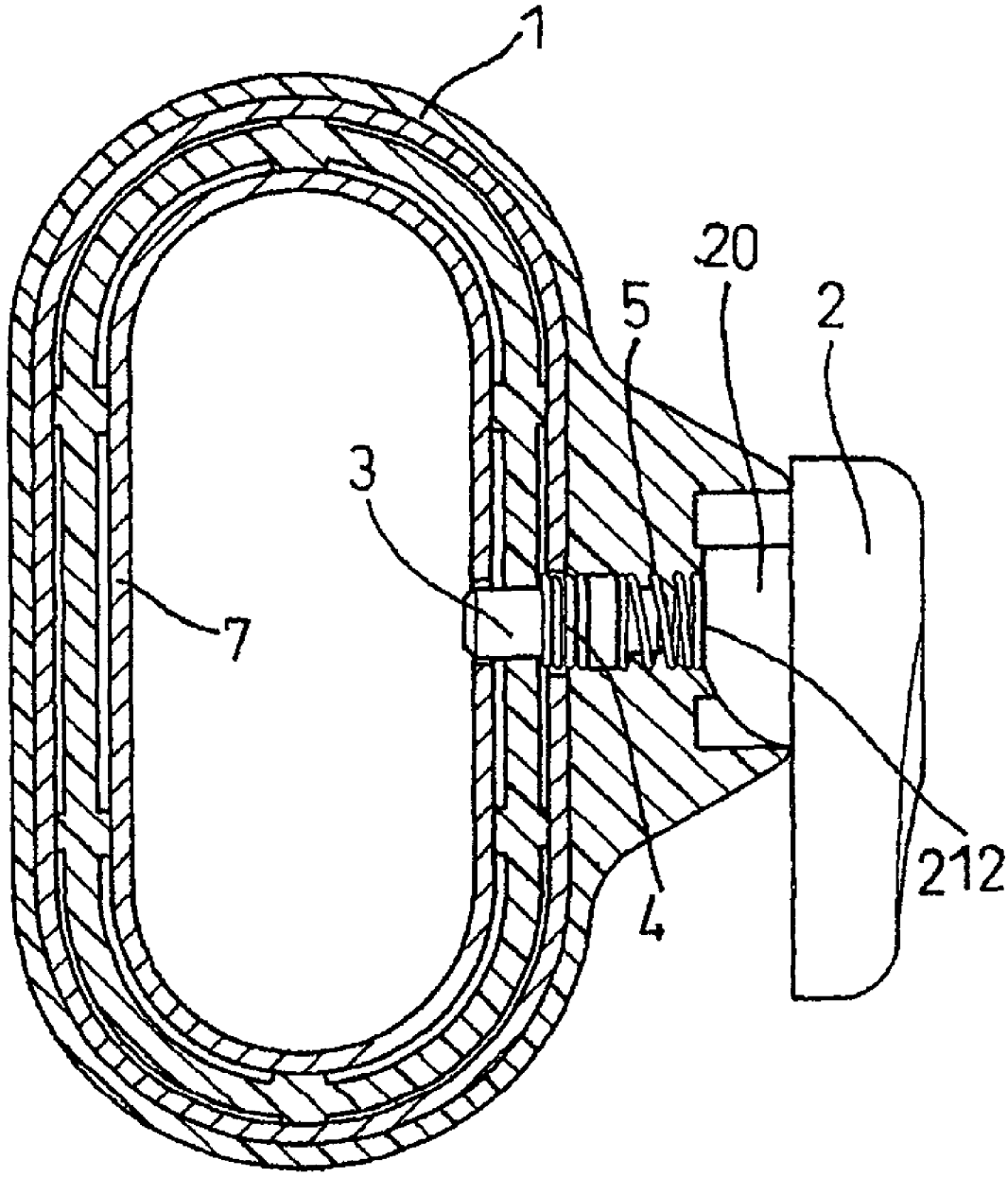
FIG. 4 is a partial schematic cross sectional view of the telescopic adjustable positioning device after actuation.

Referring to FIGS. 3 and 4, the assembly of the present invention is illustrated. Firstly, the pin 3 with the first spring 4 and the second spring 5 are installed in the slot 123. The first spring 4 resists between the flange 31 and the bottom of the slot 123. The tapered end 3*a* of the pin 3 is just at a tangent surface of the positioning hole 71 of the telescopic tube 7. When in locking, the operation unit 2 is rotated, the track 20 will move in the guide groove 122. The inclined surface 21 of the track 20 will press the second spring 5 along a direction from the first surface 211 to the second surface 212 so that the second spring 5 deforms and thus to drive the pin 3 to insert into the positioning hole 71 of the telescopic tube 7 to be locked. At this moment, the end portion 22 of the operation unit 2 will resist against the blocker 6 so that the rotation action achieve to an extreme.

Before actuation and not yet to determine a height of a support object (such as the table plate 9 in the drawing), if it is desired to look for a next positioning hole 71, it is only necessary to pull the table plate 9 to drive the telescopic tube 7 and then by the resilient force of the first spring 4 so that the pin 3 is telescopic. The tapered end 3*a* of the pin 3 is easy to slide out of the positioning hole 71 so as to fall into the positioning hole 71 and then ejects out so that the user can find a desired positioning hole 71 and then is locked.

Figure 5:
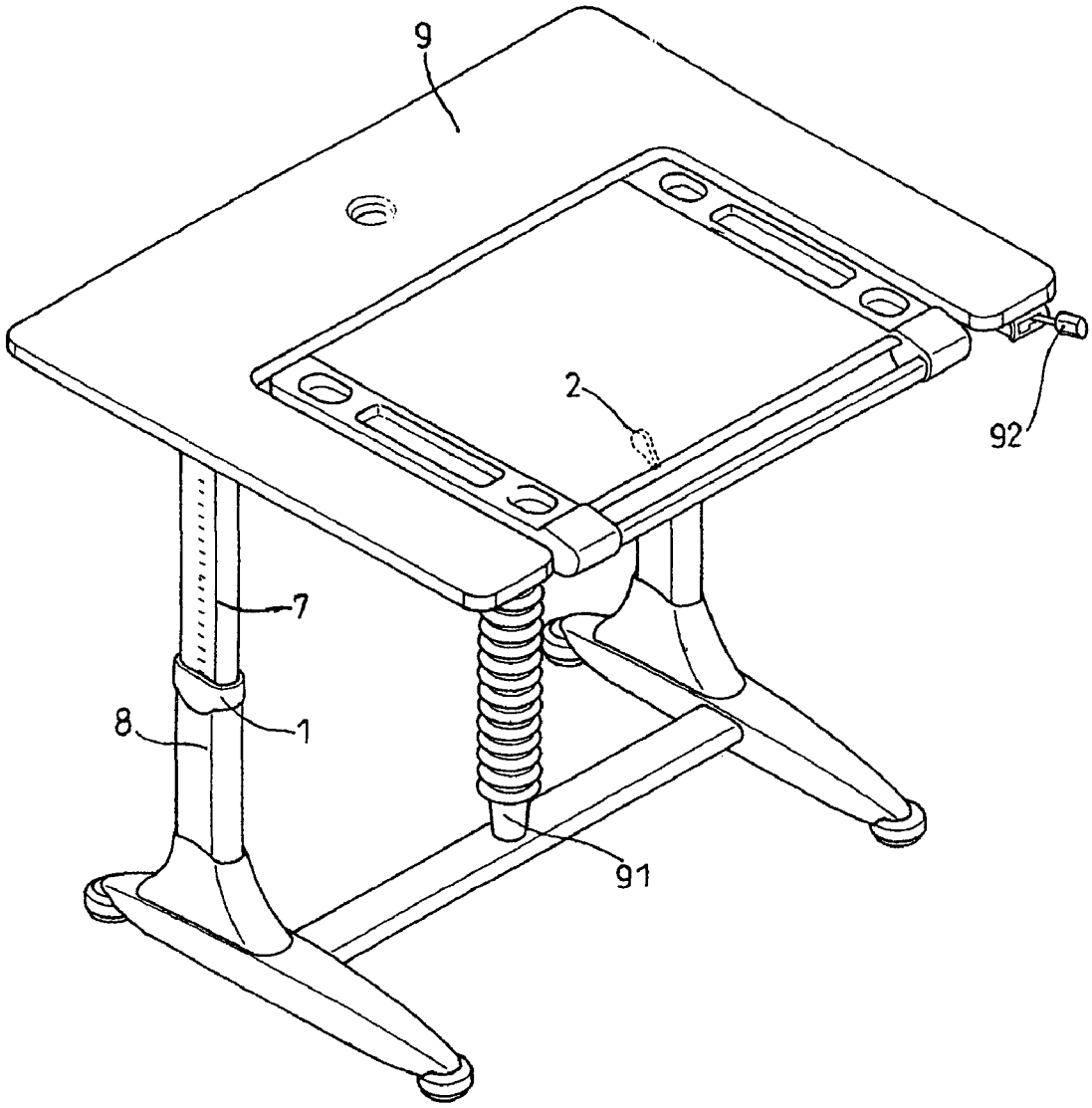
FIG. 5 is a schematic view showing one embodiment of the present invention which is applied to a table plate.
Figure 6:
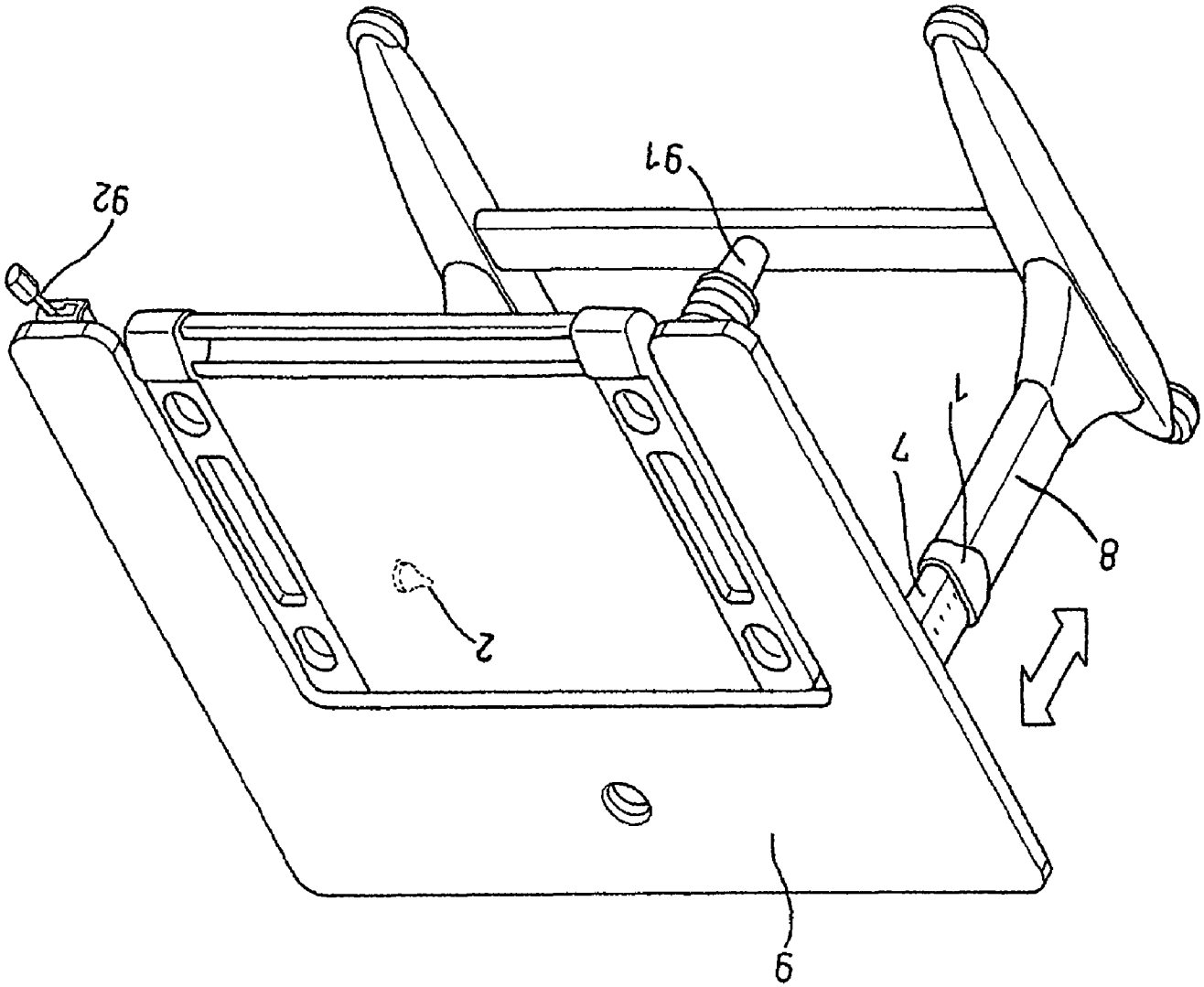
FIG. 6 is a schematic view showing the operation about the adjustment of the telescopic adjustable positioning device in FIG. 5 of the present invention.

Referring to FIGS. 5 and 6, one embodiment of the present invention is illustrated. The main body of the table plate 9 is supported by an air pressure bar 91 and the telescopic positioning device of the present invention. Therefore, when the switch 92 is actuated, by the action of the air pressure bar 91 to adjust the height and by the adjustment of the present invention, the elevation of the table plate is changed.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A telescopic adjustable positioning device comprising:

an outer sleeve having a via hole;

a telescopic tube slidably accommodated into the outer sleeve and having a plurality of positioning holes in a row;

a retaining seat, being a hollow tube, and fastened at one end of the outer sleeve for enclosing a junction of the outer sleeve and the telescopic tube, and one side of the retaining seat being formed with a projecting portion;

a slot, being formed in the projecting portion, and an inner end of the slot having a through hole which is smaller than the slot in size;

a pin, passing through the slot and the through hole of the retaining seat and the via hole of the outer sleeve to be selectively inserted into one of the positioning holes of the telescopic tube, and having a flange;

a first spring put around the pin and between the flange and the inner end of the slot, wherein a diameter of the first spring is greater than that of the through hole; and an operation unit, operatively assembled in the projecting portion of the retaining seat, having a track for pushing the pin to move toward the positioning holes;

wherein the retaining seat has a body and a toggle, the body is received in the outer sleeve, and the toggle is exposed.

2. The telescopic adjustable positioning device as claimed in claim 1, wherein an end of the pin is formed with a tapered end.

3. The telescopic adjustable positioning device as claimed in claim 1, wherein a second spring is installed at another end of the pin without the first spring, and the second spring resists against the track.

4. The telescopic adjustable positioning device as claimed in claim 1, wherein the track is formed with an inclined surface, and two ends of the track are connected to a first surface and a second surface.

5. The telescopic adjustable positioning device as claimed in claim 1, wherein an outer surface of the projecting portion is formed with a guide groove, an annular protrusion protrudes from an inner side of the guide groove, an inner side of the annular protrusion is formed with a passing hole for holding the operation unit, the guide groove communicates with the slot, and the guide groove has a blocker for blocking the operation unit.

6. The telescopic adjustable positioning device as claimed in claim 1, wherein the operation unit has a stud at an inner surface thereof, the stud has a threaded hole, and a screw passes through the threaded hole of the stud so as to assemble the operation unit into the passing hole in the projecting portion of the retaining seat.

7. The telescopic adjustable positioning device as claimed in claim 4, wherein an end portion of the first surface of the track of the operation unit is formed with a terminal portion.

8. The telescopic adjustable positioning device as claimed in claim 1, wherein an inner surface of the retaining seat is formed with ribs.

9. The telescopic adjustable positioning device as claimed in claim 1, wherein the telescopic tube is formed with a fixing hole, an elastic unit is installed in the fixing hole for being in contact with the outer sleeve, so that the telescopic tube elastically hangs on the inner wall of the outer sleeve.

10. The telescopic adjustable positioning device as claimed in claim 9, wherein the elastic unit has two hooked legs, a recess portion is formed between the two hooked legs, thereby the elastic unit is fastened by inserting the hooked legs into the fixing hole.

11. The telescopic adjustable positioning device as claimed in claim 9, wherein the elastic unit is formed into an arc, and a recess is formed in the arc.

12. The telescopic adjustable positioning device as claimed in claim 4, wherein the first surface and the second surface are planes.

* * * * *